United States Patent [19]

Hirano et al.

[11] Patent Number: 4,511,647

[45] Date of Patent: Apr. 16, 1985

[54] SILVER HALIDE COLOR PHOTOGRAPHIC LIGHT-SENSITIVE MATERIAL

[75] Inventors: Tsumoru Hirano; Morio Yagihara; Makoto Umemoto, all of Kanagawa, Japan

[73] Assignee: Fuji Photo Film Co., Ltd., Kanagawa, Japan

[21] Appl. No.: 549,947

[22] Filed: Nov. 9, 1983

[30] Foreign Application Priority Data

Nov. 9, 1982 [JP] Japan ..... 57-196575

[51] Int. Cl.[3] ..... G03C 7/16; G03C 7/26

[52] U.S. Cl. ..... 430/381; 430/384; 430/385; 430/548; 430/552; 430/553

[58] Field of Search ..... 430/548, 552, 553, 384, 430/385, 381

[56] References Cited

U.S. PATENT DOCUMENTS 3,926,436 12/1975 Monbaliu et al. ..... 430/548
4,340,664 7/1982 Monbaliu et al. ..... 430/548
4,438,278 3/1984 Ponticello et al. ..... 430/496

*Primary Examiner*—J. Travis Brown
*Attorney, Agent, or Firm*—Sughrue, Mion, Zinn, Macpeak & Seas

[57] ABSTRACT

A silver halide color photographic light-sensitive material is disclosed. Their material is comprised of a support having thereon a silver halide emulsion layer containing a cyan color image forming polymer coupler latex. This latex is comprised of a recurring unit of a cyan coupler monomer capable of forming a dye upon coupling with an oxidation product of an aromatic primary amine developing agent represented by the general formula (I) and a recurring unit of an ethylenically unsaturated monomer containing an acid component represented by the general formula (II) and a recurring unit of methyl acrylate.

(I)

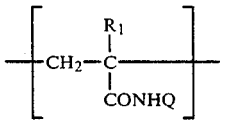

(II)

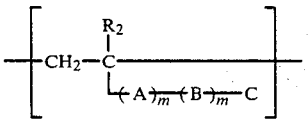

The cyan color image forming polymer coupler latex has excellent color forming properties and photographic material containing the coupler latex provides a cyan image having good fastness to heat and the combination of heat and humidity. A method for forming a color image utilizing the disclosed photographic material containing the novel couple of latex is also disclosed.

27 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a novel cyan color image forming polymer coupler latex capable of coupling with an oxidation product of an aromatic primary amine developing agent.

BACKGROUND OF THE INVENTION

It is well known that upon the color development of a silver halide photographic light-sensitive material, after exposure, an oxidized aromatic primary amine developing agent can be reacted with a dye forming coupler to obtain a color image.

It is also known that, for the color development of a silver halide color photographic material, an oxidized aromatic primary amine developing agent can be reacted with a coupler to form a dye such as an indophenol, an indoaniline, an indamine, an azomethine, a phenoxazine, a phenazine, and the like, thus forming a color image. In this procedure, the subtractive color process is ordinarily used for color reproduction, and silver halide emulsions which are selectively sensitive to blue, green and red lights, and yellow, magenta and cyan color image formers, which are respectively the complementary colors of blue, green and red, are employed. For example, a coupler of the acylacetanilide or benzoylmethane type is used for forming a yellow color image; a coupler of the pyrazolone, pyrazolobenzimidazole, cyano-acetophenone or indazolone type is generally used for forming a magenta color image; and a phenolic coupler, such as a phenol and a naphthol, is generally used for forming a cyan color image.

Color couplers must satisfy various requirements. For example, it is necessary that they provide a dye image having a good spectral property and excellent stability to light, temperature, and humidity for a long period of time upon color development.

It is also required in a multilayer color photographic light-sensitive material that each coupler is fixed in a layer separated from each other in order to reduce color mixing and improve color reproduction. Many methods for rendering a coupler diffusion-resistant are known. One method is to introduce a long chain aliphatic group into a coupler molecule in order to prevent diffusion. Couplers according to such a method require a step of addition to an aqueous gelatin solution by solubilizing in alkali, or a step of emulsion dispersing in an aqueous gelatin solution by dissolving in an organic solvent having a high boiling point, since the couplers are immiscible with an aqueous gelatin solution. Such color couplers may cause crystal formation in a photographic emulsion. Furthermore, when using an organic solvent having a high boiling point, a large amount of gelatin must be employed since the organic solvent having a high boiling point makes an emulsion layer soft. Consequently, this increases the thickness of the material even though it is desirable to reduce the thickness of the emulsion layer.

Another method for rendering a coupler diffusionresistant is to utilize a polymer coupler obtained by polymerization of a monomeric coupler in the form of a latex. An example of a method of adding a polymer coupler in a latex form to a hydrophilic colloid composition is a method in which a latex prepared by an emulsion polymerization method is directly added to a gelatino silver halide emulsion and a method in which an oleophilic polymer coupler obtained by polymerization of a monomeric coupler is dispersed in a latex form in an aqueous gelatin solution. Some examples of the former emulsion polymerization methods include an emulsion polymerization method in an aqueous gelatin phase as described in U.S. Pat. No. 3,370,952 and an emulsion polymerization method in water as described in U.S. Pat. No. 4,080,211. An example of the latter method in which an oleophilic polymer coupler is dispersed in a latex form is described in U.S. Pat. No. 3,451,820. The method of adding a polymer coupler in a latex form to an oleophilic colloid composition has many advantages in comparison with other methods. For example, the deterioration of strength of the film formed is small, because the hydrophobic substance is in a latex form. Also, since the latex can contain coupler monomers in a high concentration, it is easy to incorporate couplers in a high concentration into a photographic emulsion, and since the increase of viscosity is small, it is possible to reduce the thickness of the emulsion layer which results in the improvement in sharpness. Furthermore, color mixing is prevented, since a polymer coupler is completely immobilized and the deposition of couplers in the emulsion layer is small.

With respect to the addition of these polymer couplers in a latex form to a gelatino silver halide emulsion, there are described, for example, 4-equivalent magenta polymer coupler latexes and methods of preparation thereof in U.S. Pat. No. 4,080,211, British Pat. No. 1,247,688, and U.S. Pat. No. 3,451,820, copolymer latexes with a competitive coupler in West German Pat. No. 2,725,591, and U.S. Pat. No. 3,926,436 and cyan polymer coupler latexes in U.S. Pat. No. 3,767,412 and *Research Disclosure,* No. 21728 (1982).

However, these cyan polymer coupler latexes have unsolved problems as well as many excellent features such as those described above, and thus it has been desired to overcome these problems. The problems include the following:

1. The fastness to heat or humidity and heat of the cyan color image in a color photograph after development processing is inferior.
2. The rate of the coupling reaction is poor, and thus sensitivity, gradation and color density of the dye image formed are low.

There is a particularly strong need with respect to improvement in heat fastness.

SUMMARY OF THE INVENTION

Therefore, an object of the present invention is to provide a novel cyan color image forming polymer coupler latex which forms a color image fast to heat or humidity and heat in a color photograph after development processing.

Another object of the present invention is to provide a novel cyan color image forming polymer coupler latex which has an excellent color forming property.

A further object of the present invention is to provide a method of forming a cyan color image by development of a silver halide emulsion in the presence of a novel cyan color image forming polymer coupler latex.

A still further object of the present invention is to provide a silver halide color photographic light-sensitive material containing a novel cyan color image forming polymer coupler latex, a photographic processing method or an image forming method for using the material.

Other objects of the present invention will be apparent from the following detailed description and examples.

As a result of extensive investigations, it has now been found that these objects of the present invention are accomplished by a silver halide color photographic light-sensitive material comprising a support having thereon a silver halide emulsion layer containing a cyan color image forming polymer coupler latex which comprises at least one recurring unit of a cyan coupler monomer capable of forming a dye upon coupling with an oxidation product of an aromatic primary amine developing agent represented by the general formula (I) described below, at least one recurring unit of an ethylenically unsaturated monomer containing an acid component represented by the general formula (II) described below and at least one recurring unit of methyl acrylate (I)

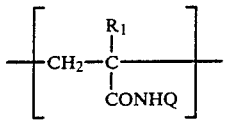

wherein $R_1$ represents a hydrogen atom, a lower alkyl group containing from 1 to 4 carbon atoms or a chlorine atom; and Q represents a cyan coupler residue capable of forming a cyan dye upon coupling with an oxidized aromatic primary amine developing agent, (II)

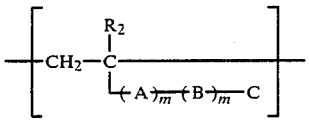

wherein $R_2$ represents a hydrogen atom, a lower alkyl group containing from 1 to 4 carbon atoms or a chlorine atom; A represents —COO— or —CONH—; b represents an alkylene group containing from 1 to 10 carbon atoms which may be a straight chain, a branched chain or a cyclic, an aralkylene group containing from 7 to 18 carbon atoms or a phenylene group containing from 6 to 10 carbon atoms (inclusive of carbon atoms of substituents for the phenylene group); C represents —COOM or —$SO_3M$; M represents a hydrogen atom ion, an alkali metal ion, an alkaline earth metal ion or an ammonium ion; and m represents 0 or 1.

DETAILED DESCRIPTION OF THE INVENTION

In more detail, preferred cyan coupler residue for Q which forms a cyan color image upon coupling with an oxidized aromatic primary amine developing agent in th cyan color image forming polymer coupler latex according to the present invention includes a phenol type residue represented by the general formula (III) or (IV) described below and a naphthol type residue represented by the general formula (V) described below.

[III]

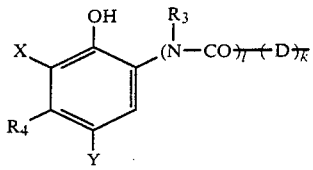

[IV]

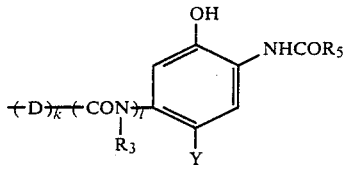

[V]

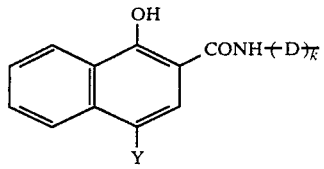

In the above formulae, $R_3$ represents a hydrogen atom or a lower alkyl group having from 1 to 4 carbon atoms; D bonds to the NH group in the general formula (I) and represents an unsubstituted or substituted alkylene group having from 1 to 10 carbon atoms which may be a straight chain or a branched chain, an unsubstituted or substituted aralkylene group having from 7 to 18 carbon atoms or an unsubstituted or substituted phenylene group having from 6 to 18 carbon atoms. Examples of the alkylene group for D include a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group for D includes a benzylidene group, etc. Examples of the phenylene group for D include a p-phenylene group, an m-phenylene group, a methylphenylene group, etc. $R_4$ represents a hydrogen atom or a lower alkyl group having from 1 to 5 carbon atoms (for example, a methyl group, an ethyl group, a tert-butyl group, etc.). $R^5$ represents an unsubstituted or substituted alkyl group, an unsubstituted or substituted phenyl group or an unsubstituted or substituted phenylamino group. X represents a halogen atom (for example, a fluorine atom, a chlorine atom, a bromine atom, etc.). Y represents a hydrogen atom, a halogen atom (for example, a fluorine atom, a chlorine atom, a bromine atom, etc.) or a substituted alkoxy group. k represents 0 or 1; and l represents 0 or 1.

Substituents for the alkylene group, the aralkylene group or the phenylene group represented by D include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, amethoxycarbonyl group, etc.), a sulfonyl group (for example, a methylsulfonyl group, etc.), and the like. When two or more substituents are present, they may be the same or different.

Substituents for the substituted alkoxy group represented by Y include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), an alkylsulfonamido group (for example, a methanesulfonamido group, etc.), an alkylsulfamoyl group (for example, a methylsulfamoyl group, etc.), a halogen atom (for example, a fluorine atom, a chlorine atom, a bromine atom, etc.), a carboxy group, an alkylcarbamoyl group (for example, a methylcarbamoyl group, etc.), an alkoxycarbonyl group (for example, a methoxycarbonyl group, etc.), an alkylsulfonyl group (for example, a methylsulfonyl group, etc.), an alkylthio group (for example, a $\beta$-carboxyethylthio group, etc.), and the like. When two or more substituents are present, they may be the same or different.

Substituent for the alkyl group or the phenyl group represented by $R_5$ is preferably a fluorine atom. Substituents for the phenylamino group represented by $R_5$ include a nitro group, a cyano group, a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carbamoyl group (for example, a methylcarbamoyl group, etc.), a sulfonyl group (for example, a methylsulfonyl group, etc.), and the like. When two or more substituents are present, they may be the same or different.

The recurring unit represented by the general formula (II) above which is derived from an ethylenically unsaturated monomer containing an acid component which does not have an ability of oxidative coupling with an aromatic primary amine developing agent includes acrylic acid, $\alpha$-chloroacrylic acid, an $\alpha$-alkylacrylic acid (for example, methacrylic acid), etc. and an ester and an amide derived therefrom each containing an acid component.

The alkylene group represented by B in the general formula (II) include, for example, a methylene group, a methylmethylene group, an ethylene group, a methylethylene group, a dimethylethylene group, a trimethylene group, a tetramethylene group, a pentamethylene group, a hexamethylene group, a decylmethylene group, etc. The aralkylene group represented by B in the general formula (II) include, for example, a benzylidene group, etc. The phenylene group represented by B in the general formula (II) include, for example, a p-phenylene group, a m-phenylene group, etc.

Two or more kinds of the recurring units represented by the general formulae (I) and (II) can be used together.

The cyan polymer coupler latex used in the present invention can be prepared, as described above, by dissolving an oleophilic polymer coupler obtained by polymerization of a monomer coupler in an organic solvent and then emulsion dispersing the solution in a latex form in an aqueous gelatin solution, or can be directly prepared by an emulsion polymerization method. With respect to the method in which an oleophilic polymer coupler is emulsion dispersed in a latex form in an aqueous gelatin solution, the method as described in U.S. Pat. No. 3,451,820 and with respect to the emulsion polymerization, the methods as described in U.S. Pat. Nos. 4,080,211 and 3,370,952 can be employed, respectively.

General polymerization methods for preparing the cyan polymer couplers are hereinafter described.

Free radical polymerization of an ethylenically unsaturated solid monomer is initiated with the addition to the monomer molecule of a free radical which is formed by thermal decomposition of a chemical initiator, an action of a reducing agent to an oxidative compound (a redox initiator) or a physical action, for example, irradiation of ultraviolet rays or other high energy radiations, high frequencies, etc.

Examples of the chemical initiators commonly used include a persulfate (for example, ammonium persulfate, potassium persulfate, etc.), an azobis type polymerization initiator (for example, dimethyl 2,2'-azobisisobutyrate, diethyl 2,2'-azobisisobutyrate, 2,2'-azobisisobutyronitrile, 2,2'-azobis-(2,4-dimethylvaleronitrile), 4,4'-azobis(4-cyanovaleric acid), etc.), a peroxide type polymerization initiator (for example, benzoyl peroxide, chlorobenzene peroxide, hydrogen peroxide, etc.), etc. Examples of the redox initiators usually used include hydrogen peroxideiron (II) salt, potassium persulfate-potassium hydrogensulfate, cerium salt-alcohol, etc. Specific examples and functions of the initiators are described in F. A. Bovey, *Emulsion Polymerizaion,* pages 59 to 93 (Interscience Publishers Inc., New York (1955)).

Solvents which can be used in polymerization of the oleophilic polymer couplers are preferably those which can usually be admixed with monomers to be used without limitation, are good solvents for the oleophilic polymer couplers formed, do not react with initiators to be used and do not interrupt usual actions in free radical addition polymerization.

Specific examples of the solvents which can be used include an aromatic hydrocarbon (for example, benzene, toluene, etc.), a hydrocarbon (for example, n-hexane, etc.), an alcohol (for example, methanol, ethanol, n-propanol, isopropanol, tert-butanol, etc.), a ketone (for example, acetone, methyl ethyl ketone, etc.), a cyclic ether (for example, tetrahydrofuran, dioxane, etc.), an ester (for example, ethyl acetate, etc.), a chlorinated hydrocarbon (for example, methylene chloride, chloroform, etc.), an amide (for example, dimethylformamide, dimethylacetamide, etc.), a sulfoxide (for example, dimethyl sulfoxide, etc.), a nitrile (for example, acetonitrile, etc.), and a mixture thereof.

On the other hand, emulsion polymerization of solid water-insoluble monomer couplers is usually carried out in an aqueous system or a water/organic solvent system. Organic solvents which can be used are preferably those which are substantially inert to solid water-insoluble monomer couplers to be used, do not interrupt usual actions in free radical addition polymerization and have a low boiling point so as to be capable of being easily removed from an aqueous reaction medium by distillation during and/or after polymerization, same as the organic solvents described above. Preferred examples include a lower alcohol having from 1 to 4 carbon atoms (for example, methanol, ethanol, isopropanol, etc.), a ketone (for example, acetone, etc.), a chlorinated hydrocarbon (for example, chloroform, etc.), an aromatic hydrocarbon (for example, benzene, etc.), a cyclic ether (for example, tetrahydrofuran, etc.), an ester (for example, ethyl acetate, etc.), a nitrile for example, acetonitrile, etc.), and the like.

As an emulsifier which can be used in the emulsion polymerization, a compound having surface activity is used. Preferred examples include soap, a sulfonate, a sulfate, a cationic compound, an amphoteric compound and a high molecular weight protective colloid. Specific examples and functions of the emulsifiers are described in *Belgische Chemische Industrie,* Vol. 28, pages 16 to 20 (1963).

A polymerization temperature should be determined with reference to a molecular weight of the polymer formed, a kind of a initiator to be used, etc. and can be from about 0° C. to about 100° C. Usually, the polymerization is carried out in a range from 30° C. to 100° C.

Further, an organic solvent which is used for dissolving an oleophilic polymer coupler in the case where the oleophilic polymer coupler is dispersed in a latex form in an aqueous gelatin solution is removed from the mixture before coating of the dispersion solution or by vaporization during drying of the dispersion solution coated, although the latter is less preferable. With respect to removing the solvent, a method in which the solvent is removed by washing a gelatin noodle with water is applied when the solvent is water-soluble to some extent, or a spray drying method, a vacuum purging method or a steam purging method can be employed for removing the solvent.

Examples of the organic solvents which can be removed include, for example, an ester (for example, a lower alkyl ester, etc.), a lower alkyl ether, a ketone, a halogenated hydrocarbon (for example, methylene chloride, trichloroethylene, a fluorinated hydrocarbon, etc.), an alcohol (for example, n-butyl alcohol, n-hexyl alcohol, n-octyl alcohol, etc.), and a mixture thereof.

Any type of dispersing agent can be used in the dispersion of the oleophilic polymer coupler. Ionic surface active agents, and particularly anionic surface active agents, are preferred. Amphoteric surface active agents such as C-cetylbetaine, an N-alkyaminopropionate, an N-alkyliminodipropionate, etc., can also be used.

In order to control the color hue of a dye formed from a polymer coupler and the oxidation product of an aromatic primary amine developing agent and to improve the flexibility of the emulsion coated, a permanent solvent, that is, a water-immiscible organic solvent having a high boiling point (i.e., above 200° C.), may be added. Furthermore, it is desirable to use the permanent solvent in a relatively low concentration in order to reduce the thickness of a final emulsion layer as much as possible to obtain good sharpness.

It is desirable that a proportion of the color forming portion corresponding to the general formula (I) in the polymer coupler is usually from 5 to 80% by weight. Particularly, a proportion from 20 to 70% by weight is preferred in view of color reproducibility, color forming property and stability. Also, it is desirable that a proportion of the non-color forming portion corresponding to the general formula (II) in the polymer coupler is usually from 1 to 30% by weight. Particularly, a proportion from 5 to 20% by weight is preferred in view of color reproducibility, color forming property and fastness. Further, it is desirable that a proportion of methyl acrylate in the polymer coupler is usually from 20 to 95% by weight. Particularly, a proportion from 30 to 70% by weight is preferred in view of color reproducibility, color forming property and fastness. In this case, an equivalent molecular weight, that is, a gram number of the polymer containing 1 mol of a monomer coupler is from about 250 to 4,000, but it is not limited thereto.

Specific examples of monomer couplers suitable for preparing the cyan polymer coupler latex according to the present invention are described in various literature references, for example, U.S. Pat. Nos. 2,976,294, 3,767,412, 4,080,211 and 4,128,427, *Research Disclosure,* No. 21728 (1982), etc.

Representative examples of the monomer couplers which can be used in the present invention are set forth below, but the present invention is not to be construed as being limited thereto.

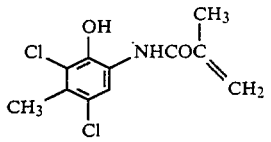
(1)

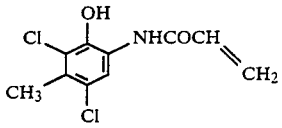
(2)

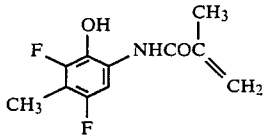
(3)

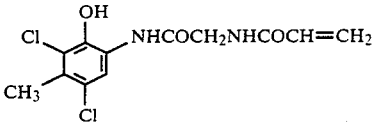
(4)

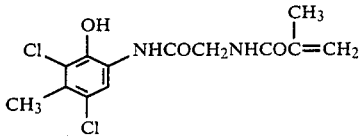
(5)

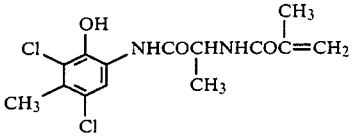
(6)

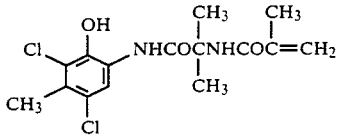
(7)

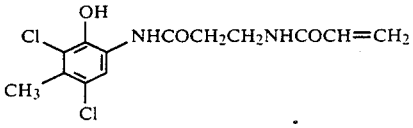
(8)

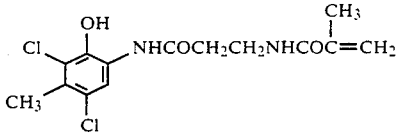
(9)

-continued (10)

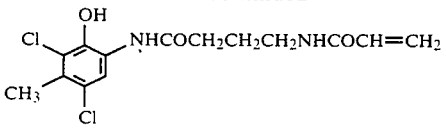

(11)

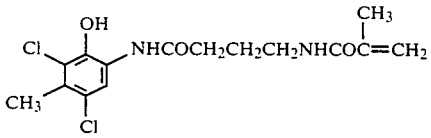

(12)

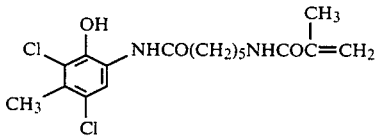

(13)

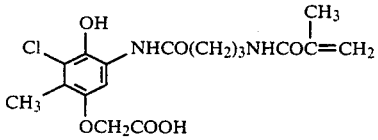

(14)

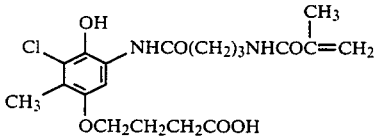

(15)

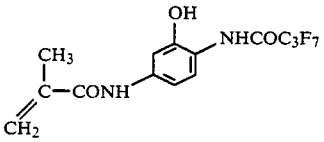

(16)

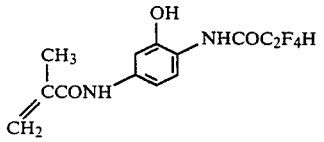

(17)

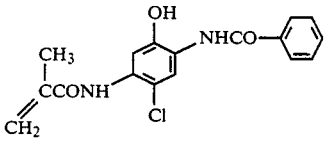

(18)

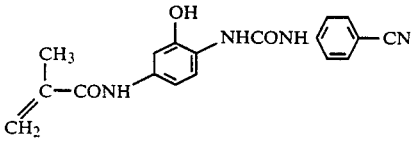

(19)

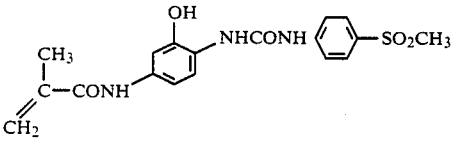

(20)

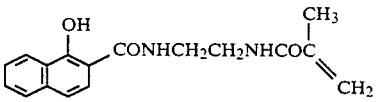

-continued (21)

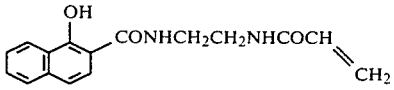

(22)

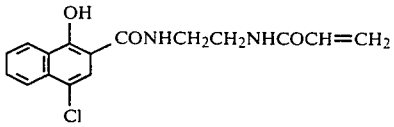

(23)

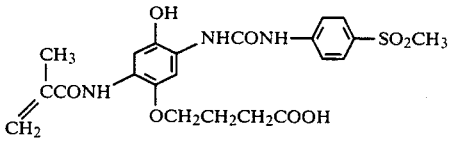

(24)

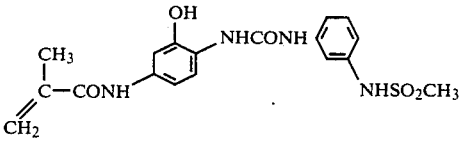

(25)

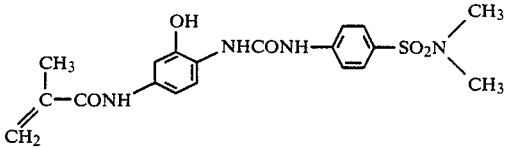

Specific examples of the ethylenically unsaturated monomer containing an acid component (corresponding to the general formula (II)) which are suitable for preparing the cyan polymer coupler latex according to the present invention are set forth below, but the present invention is not to be construed as being limited thereto.

$CH_2=CH-COOH$ (i)

$CH_2=C(CH_3)-COOH$ (ii)

$CH_2=CH-CONHCH_2COOH$ (iii)

$CH_2=C(CH_3)-CONHCH_2COOH$ (iv)

$CH_2=C(CH_3)-CONHCH(CH_3)COOH$ (v)

$CH_2=C(CH_3)-CONHCH_2CH_2COOH$ (vi)

$CH_2=C(CH_3)-CONH(CH_2)_3COOH$ (vii)

$CH_2=C(CH_3)-CONH(CH_2)_5COOH$ (viii)

$CH_2=CH-CONH(CH_2)_{10}COOH$ (ix)

$CH_2=CH-CONH-CH(CH_3)-CH_2SO_3H$ (x)

Typical synthesis examples of the cyan polymer coupler latexes according to the present invention are hereinafter set forth.

Synthesis Method I

SYNTHESIS EXAMPLE 1

Synthesis of copolymer coupler of 6-methacrylamido-2,4-dichloro-3-methylphenol [Monomer Coupler (1)], methyl acrylate and methacrylic acid [Oleophilic Polymer Coupler (A)]

A mixture composed of 20 g of Monomer Coupler (1), 16 g of methylacrylate, 4 g of methacrylic acid and 200 ml of dioxane was heated to 800° C. with stirring while introducing nitrogen gas. To the mixture was added 10 ml of a dioxane containing 600 mg of dimethyl azobisisobutyrate dissolved to initiate polymerization. After reacting for 5 hours, the reaction solution was cooled and poured into 1.5 liters of water. The solid thus deposited were collected by filtration and thoroughly washed with water. By drying the solid under a reduced pressure with heating, 37.2 g of Oleophilic Polymer Coupler (A) was obtained. It was found that the oleophilic polymer coupler contained 50.3% of Monomer Coupler (1) in the copolymer synthesized as the result of chlorine analysis.

A method for dispersing oleophilic Polymer Coupler (A) in an aqueous gelatin solution in the form of a latex is described in the following.

Synthesis of Polymer Coupler Latex (A')

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Oleophilic Polymer Coupler (A) described above was dissolved in 200 ml of ethyl acetate at 38° C.

Solution (b) was put into a mixer with explosion preventing equipment while stirring at a high speed and to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (A').

SYNTHESIS EXAMPLE 2

Synthesis of copolymer coupler of 6-acrylamido-2,4-dichloro-3-methylphenol [Monomer Coupler (2)], methyl acrylate and acrylic acid [Oleophilic Polymer Coupler (B)]

A mixture composed of 20 g of Monomer Coupler (2), 16 g of methyl acrylate, 4 g of acrylate acid and 200 ml of dioxane was heated to 80° C. with stirring while introducing nitrogen gas. To the mixture was added 10 ml of dioxane containing 600 mg of dimethyl azobisisobutyrate dissolved to initiate polymerization. After reacting for 5 hours, the reaction solution was cooled and poured into 1.5 liters of water. The solid thus deposited was collected by filtration and thoroughly washed with water. By drying the solid under a reduced pressure with heating, 37.5 g of Oleophilic Polymer Coupler (B) was obtained. It was found that the oleophilic polymer coupler contained 49.9% of Monomer Coupler (2) in the copolymer synthesized as the result of chlorine analysis.

A method for dispersing Oleophilic Polymer Coupler (B) in an aqueous gelatin solution in the form of a latex is described in the following.

Synthesis of Polymer Coupler Latex (B')

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Oleophilic Polymer Coupler (B) described above was dissolved in 200 ml of ethyl acetate at 38° C.

Solution (b) was put into a mixer with explosion preventing equipment while stirring at high speed and to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (B').

SYNTHESIS EXAMPLE 3

Synthesis of copolymer coupler of 6-(3-methacrylamido-propaneamido)-2,4-dichloro-3-methylphenol [Monomer Coupler (9)], methyl acrylate and methacrylic acid [Oleophilic Polymer Coupler (C)]

A mixture composed of 20 g of Monomer Coupler (9), 18 g of methyl acrylate, 2 g of methacrylic acid and 200 ml of dioxane was heated to 80° C. with stirring while introducing nitrogen gas. To the mixture was added 10 ml of dioxane containing 600 mg of dimethyl azobisisobutyrate dissolved to initiate polymerization. After reacting for 5 hours, the reaction solution was cooled and poured into 1.5 liters of water. The solid thus deposited was collected by filtration and thoroughly washed with water. By drying the solid under a reduced pressure with heating, 38.2 g of Oleophilic Polymer Coupler (C) was obtained. It was found that the oleophilic polymer coupler contained 50.5% of Monomer Coupler (9) in the copolymer synthesized as the result of chlorine analysis.

A method for dispersing Oleophilic Polymer Coupler (c) in an aqueous gelatin solution in the form of a latex is described in the following.

Synthesis of Polymer Coupler Latex (C')

Two solutions (a) and (b) were prepared in the following manner.

Solution (a): 200 g of a 3.0% by weight aqueous solution of bone gelatin (pH of 5.6 at 35° C.) was heated to 38° C. and to which was added 16 ml of a 10% by weight aqueous solution of sodium lauryl sulfate.

Solution (b): 20 g of Oleophilic Polymer Coupler (C) described above was dissolved in 200 ml of ethyl acetate at 38° C.

Solution (b) was put into a mixer with explosion preventing equipment while stirring at high speed and to which was rapidly added solution (a). After stirring for 1 minute, the mixer was stopped and ethyl acetate was removed by distillation under a reduced pressure. Thus, the oleophilic polymer coupler was dispersed in a diluted gelatin solution to prepare Polymer Coupler Latex (C').

SYNTHESIS EXAMPLES 4 TO 22

Using the above-described monomer couplers, Oleophilic Polymer Couplers (D) to (V) described below were prepared in the same manner as described for the copolymers in Synthesis Examples 1 to 3.

Oleophilic Polymer Couplers by Synthesis Method I

| Synthesis Example | Oleophilic Polymer Coupler | Monomer Coupler | Amount (g) | Non-Color Forming, Acid Component Containing Monomer | Amount (g) | Non-Color Forming Monomer: MA Amount (g) | Monomer Coupler Unit in Polymer (wt %) |
|---|---|---|---|---|---|---|---|
| 4 | D | (1) | 20 | (I) | 4 | 16 | 52.1 |
| 5 | E | (1) | 20 | (II) | 5 | 25 | 41.8 |
| 6 | F | (1) | 20 | (VI) | 3 | 10 | 60.8 |
| 7 | G | (1) | 20 | (X) | 2 | 18 | 51.5 |
| 8 | H | (2) | 20 | (II) | 4 | 16 | 50.7 |
| 9 | I | (2) | 20 | (VI) | 4 | 16 | 51.4 |
| 10 | J | (2) | 20 | (VIII) | 2 | 18 | .52.1 |
| 11 | K | (5) | 20 | (II) | 4 | 16 | 50.6 |
| 12 | L | (6) | 20 | (I) | 4 | 16 | 52.0 |
| 13 | M | (9) | 20 | (I) | 6 | 24 | 42.5 |
| 14 | N | (9) | 20 | (II) | 2 | 18 | 52.2 |
| 15 | O | (9) | 20 | (II) | 6 | 14 | 52.6 |
| 16 | P | (11) | 20 | (I) | 3 | 10 | 60.4 |
| 17 | Q | (11) | 20 | (VI) | 4 | 16 | 51.5 |
| 18 | R | (11) | 20 | (VII) | 4 | 16 | 50.8 |
| 19 | S | (15) | 20 | (II) | 4 | 16 | 51.6 |
| 20 | T | (15) | 20 | (VI) | 5 | 25 | 42.3 |
| 21 | U | (20) | 20 | (II) | 5 | 75 | 21.9 |
| 22 | V | (21) | 20 | (X) | 2 | 18 | 52.2 |

The amounts of the monomer couplers, the non-color forming, acid component containing monomers and the non-color forming monomers (MA) in the above table indicate amounts used in the synthesis of the oleophilic polymer couplers.

Dispersion of these oleophilic polymer couplers in the form of a latex can be carried out in the same manner as described in Synthesis Examples 1 to 3.

Synthesis Method II

SYNTHESIS EXAMPLE 23

Synthesis of copolymer coupler latex of 6-methacrylamido-2,4-dichloro-3-methylphenol [Monomer Coupler (1)], methyl acrylate and methacrylic acid [Polymer Coupler Latex (I)]

1 Liter of an aqueous solution containing 2 g of oleyl methyl tauride dissolved was heated to 85° C. with stirring while introducing nitrogen gas in a 2 liter flask. To the aqueous solution was added 15 ml of a 2% aqueous solution of potassium persulfate and then was added dropwise over a period of 20 minutes a solution prepared by dissolving with heating 20 g of Monomer Coupler (1), 16 g of methyl acrylate and 4 g of methacrylic acid in 300 ml of methanol. After reacting for 1 hour, 6 ml of a 2% aqueous solution of potassium persulfate was added. After further reacting for 1 hour, the methanol was distilled off. The latex thus formed was cooled, pH of which was adjusted to 6.0 with a 1N sodium hydroxide solution and filtered. The concentration of the polymer in the latex formed was 5.2% and it was found that the polymer contained 52.6% of Monomer Coupler (1) as the result of chlorine analysis.

SYNTHESIS EXAMPLE 24

Synthesis of copolymer coupler latex of 6-3-methacrylamido propanamido)-2,4-dichloro-3-methylphenol [Monomer Coupler (9)], methyl acrylate and methacrylic acid [Polymer Coupler Latex (II)]

400 ml of an aqueous solution containing 2.1 g of oleyl methyl tauride dissolved was heated to 80° C. with stirring while introducing nitrogen gas in a 1 liter flask. To the aqueous solution were added 2 ml of a 2% aqueous solution of potassium persulfate and 4 g of methyl acrylate. After 1 hour, 20 g of Monomer Coupler (9), 16 g of methyl acrylate, 4 g of methacrylic acid and 200 ml of methanol were added and then 14 ml of a 2% aqueous solution of potassium persulfate was added. After 1 hour, 6 ml of a 2% aqueous solution of potassium persulfate was added. After further reacting for 1 hour, the methyl acrylate not reacted and the methanol were distilled off. The latex thus formed was cooled, pH of which was adjusted to 6.0 with a 1N sodium hydroxide solution and filtered. The concentration of the polymer in the latex formed was 11.6% and it was found that the polymer contained 48.1% of Monomer Coupler (9) as the result of chlorine analysis.

SYNTHESIS EXAMPLES 25 TO 37

Using the above-described monomer couplers, Polymer Coupler Latexes (III) to (XV) described below were prepared in the same manner as described for the copolymers in Synthesis Example 24.

Polymer Coupler Latexes by Synthesis Method II

| Synthesis Example | Polymer Coupler Latex | Monomer Coupler | Amount (g) | Non-Color Forming, Acid Component Containing Monomer | Amount (g) | Non-Color Forming Monomer: MA Amount (g) | Monomer Coupler Unit in Polymer (wt %) |
|---|---|---|---|---|---|---|---|
| 25 | III | (1) | 20 | (I) | 4 | 20 | 47.3 |
| 26 | IV | (1) | 20 | (X) | 4 | 20 | 46.7 |

-continued

| Polymer Coupler Latexes by Synthesis Method II | | | | | | | |
|---|---|---|---|---|---|---|---|
| Synthesis Example | Polymer Coupler Latex | Monomer Coupler | Amount (g) | Non-Color Forming, Acid Component Containing Monomer | Amount (g) | Non-Color Forming Monomer: MA Amount (g) | Monomer Coupler Unit in Polymer (wt %) |
| 27 | V | (2) | 20 | (II) | 4 | 20 | 48.1 |
| 28 | VI | (2) | 20 | (VI) | 3 | 21 | 47.8 |
| 29 | VII | (4) | 20 | (II) | 4 | 20 | 46.3 |
| 30 | VIII | (8) | 20 | (I) | 6 | 18 | 45.8 |
| 31 | IX | (9) | 20 | (I) | 2 | 22 | 47.3 |
| 32 | X | (9) | 20 | (X) | 4 | 20 | 48.1 |
| 33 | XI | (11) | 20 | (II) | 3 | 20 | 47.2 |
| 34 | XII | (15) | 20 | (II) | 6 | 45 | 30.9 |
| 35 | XIII | (15) | 20 | (VI) | 4 | 20 | 47.5 |
| 36 | XIV | (18) | 20 | (II) | 6 | 45 | 31.0 |
| 37 | XV | (20) | 20 | (X) | 6 | 45 | 30.7 |

The amounts of the monomer couplers, the non-color forming, acid component containing monomers and the non-color forming monomers (MA) in the above table indicate amounts used in the synthesis of the polymer coupler latexes.

The cyan polymer coupler latex according to the present invention can be used individually or as mixtures of two or more thereof.

The cyan polymer coupler latex according to the present invention can also be used together with a cyan polymer coupler latex, such as those described in U.S. Pat. No. 4,080,211, West German Pat. No. 2,725,591, U.S. Pat. No. 3,926,436 and *Research Disclosure,* No. 21728, etc.

Further, a dispersion which is prepared by dispersing a hydrophobic cyan color forming coupler such as a phenol coupler or a naphthol coupler, for example, a cyan coupler, as described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76 and 73050/80, etc., in a hydrophilic colloid in a manner as described, for example, in U.S. Pat. Nos. 2,269,158, 2,272,191, 2,304,940, 2,311,020, 2,322,027, 2,360,289, 2,772,163, 2,801,170, 2,801,171, and 3,619,195, British Pat. No. 1,151,590, West German Pat. No. 1,143,707, etc., is loaded into the cyan polymer coupler latex according to the present invention in a manner as described in Japanese Patent Publication No. 39853/76, etc., and the resulting latex can be used. It is also possible for the above-described hydrophobic cyan coupler to be loaded into the cyan polymer coupler latex according to the present invention in a manner as described in Japanese Patent Application (OPI) Nos. 59942/76 and 32552/79, U.S. Pat. No. 4,199,363, etc., and the resulting latex can be used. The term "load" used herein refers to the state in which a hydrophobic cyan coupler is incorporated into the interior of a cyan polymer coupler latex, or a state in which a hydrophobic cyan coupler is deposited on the surface of a cyan polymer coupler latex. However, the mechanism by which the load occurs is not accurately known.

In order to satisfy the characteristics required of the photographic light-sensitive material, a dispersion which is prepared by dispersing a development inhibitor releasing (DIR) coupler as described, for example, in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436 and 3,808,945, British Pat. Nos. 1,201,110 and 1,236,767, etc., in a hydrophilic colloid in a manner as described in U.S. Pat. Nos. 2,269,158, 2,272,191, 2,304,940, 2,311,020, 2,322,027, 2,360,289, 2,772,163, 2,801,170, 2,801,171 and 3,619,195, British Pat. No. 1,151,590, West German Pat. No. 1,143,707, etc., is loaded into the cyan polymer coupler latex according to the present invention in a manner as described in Japanese Patent Publication No. 39853/76, etc. and the resulting latex can then be used, or the above-described DIR coupler is loaded into the cyan polymer coupler latex in a manner as described in Japanese Patent Application (OPI) Nos. 59942/76 and 32552/79, U.S. Pat. No. 4,199,363, etc., and the resulting latex can then be used.

Furthermore, the cyan polymer coupler latex according to the present invention can be used together with a DIR compound as described, for example, in West German Patent Application (OLS) Nos. 2,529,350, 2,448,063 and 2,610,546, U.S. Pat. Nos. 3,928,041, 3,958,993, 3,961,959, 4,049,455, 4,052,213, 3,379,529, 3,043,690, 3,364,022, 3,297,445 and 3,287,129.

Moreover, the cyan polymer coupler latex according to the present invention can be used in combination with a competitive coupler as described, for example, in U.S. Pat. Nos. 3,876,428, 3,580,722, 2,998,314, 2,808,329, 2,742,832 and 2,689,793, etc., a stain preventing agent as described, for example, in U.S. Pat. Nos. 2,336,327, 2,728,659, 2,336,327, 2,403,721, 2,701,197 and 3,700,453, etc., a dye image stabilizing agent as described, for example, in British Pat. No. 1,326,889, U.S. Pat. Nos. 3,432,300, 3,698,909, 3,574,627, 3,573,050 and 3,764,337, etc., or the like.

The color photographic light-sensitive material produced according to the present invention can also contain conventionally well known coupler(s) other than a cyan color forming coupler. A non-diffusible coupler which contains a hydrophobic group, called a ballast group, in the molecule thereof is preferred as a coupler. A coupler can have either a 4-equivalent or a 2-equivalent property with respect to the silver ion. In addition, a colored coupler providing a color correction effect, or a coupler which releases a development inhibitor upon a development can also be present therein. Furthermore, a coupler which provides a colorless product upon coupling can be employed.

A known open chain ketomethylene type coupler can be used as a yellow color forming coupler. Of these couplers, benzoyl acetanilide type and pivaloyl acetanilide type compounds are especially effective. Specific examples of yellow color forming couplers wihch can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76 and 87650/75, etc.

A 5-pyrazolone coupler, a pyrazolobenzimidazole coupler, a cyanoacetylcumaron coupler, an open chain acylacetonitrile coupler, etc., can be used as a magenta color forming coupler. Specific examples of magenta color forming couplers which can be employed are described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78, etc.

Two or more kinds of the couplers described above can be incorporated into the same layer, or the same coupler compound can also be present in two or more layers.

The polymer coupler latex according to the present invention is used in such an amount that the amount of the portion corresponding to the coupler monomer is from $2\times10^{-3}$ to $5\times10^{-1}$ mol, and preferably, from $1\times10^{-2}$ to $5\times10^{-1}$ mol per mol of silver.

A known method, for example, the method described in U.S. Pat. No. 2,322,027, can be used in order to incorporate the couplers described above into a silver halide emulsion layer. The coupler is dispersed in a hydrophilic colloid and then mixed with a silver halide emulsion. When a coupler having an acid group such as a carboxylic acid group, a sulfonic acid group, etc., is used, it can be incorporated into a hydrophilic colloid as an alkaline aqueous solution thereof.

The silver halide emulsions which can be used in the present invention are those wherein silver chloride, silver bromide, or a mixed silver halide such as silver chlorobromide, silver iodobromide, or silver chloroiodobromide is finely dispersed in a hydrophilic polymer such as gelatin. The silver halide can be chosen depending on the intended use of the photographic light-sensitive material from dispersions having a uniform grain size or those having a wide grain size distribution or from dispersions having an average grain size of from about 0.1 micron to about 3 microns. These silver halide emulsions can be prepared, for example, by a single jet method, by a double jet method or a controlled double jet method, or by a ripening method such as an ammonia method, a neutral method, or an acid method. Also, these silver halide emulsions can be subjected to chemical sensitization such as a sulfur sensitization, a gold sensitization, a reduction sensitization, etc., and can contain a speed increasing agent such as a polyoxyethylene compound, an onium compound, etc. Further, a silver halide emulsion of the type wherein latent images are predominantely formed on the surface of the grains or of the type where latent images are predominantly formed inside the grains can be used in the present invention. Also, two or more kinds of silver halide photographic emulsions prepared separately and then mixed can be employed.

Suitable examples of a hydrophilic high molecular weight substance composed of the photographic light-sensitive layer of the present invention include a protein such as gelatin, etc., a high molecular weight non-electrolyte such as polyvinyl alcohol, polyvinyl pyrrolidone, polyacrylamide, etc., an acidic high molecular weight substance such as an alginate, a polyacrylic and salt, etc., a high molecular weight ampholite such as a polyacrylamide treated with the Hoffman rearrangement reaction, a copolymer of acrylic acid and N-vinylimidazole, etc., a cross-linkable polymer such as those described in U.S. Pat. No. 4,215,195, and the like. Furthermore, a dispersion of a hydrophobic high molecular weight substance such as a latex of polybutyl acrylate, etc., can be included in the continuous phase of such a hydrophilic high molecular weight substance.

The silver halide emulsion used in the present invention can be chemically sensitized, as noted above, using conventional methods. Examples of suitable chemical sensitizers include, for example, a gold compound such as a chloroaurate and gold trichloride, as described in U.S. Pat. Nos. 2,399,083, 2,540,085, 2,597,856, and 2,597,915; a salt of a noble metal, such as platinum, palladium, iridium, rhodium and ruthenium, as described in U.S. Pat. Nos. 2,448,060, 2,540,086, 2,556,245, 2,566,263 and 2,598,079; a sulfur compound capable of forming silver sulfide by reacting with a silver salt, such as those described in U.S. Pat. Nos. 1,574,944, 2,410,689, 3,189,458 and 3,501,313; a stannous salt, an amine, and other reducing compounds such as those described in U.S. Pat. Nos. 2,487,850, 2,518,698, 2,521,925, 2,521,926, 2,694,637, 2,983,610 and 3,201,254 and the like.

Various compounds can be added to the photographic emulsions used in the present invention in order to prevent a reduction of the sensitivity or a formation of fog during preparation, storage, or processing. A wide variety of such compounds are known, such as a heterocyclic compound, mercury-containing compound, a mercapto compound or a metal salt, including 4-hydroxy-6-methyl-1,3,3a,7-tetraazaindene, 3-methylbenzothiazole and 1-phenyl-5-mercaptotetrazole, etc. Other examples of such compounds which can be used are described, for example, in U.S. Pat. Nos. 1,758,576, 2,110,178, 2,131,038, 2,173,628, 2,697,040, 2,304,962, 2,324,123, 2,349,198, 2,444,605-8, 2,566,245, 2,694,716, 2,697,099, 2,708,162, 2,728,663-5, 2,476,536, 2,824,001, 2,843,491, 2,886,437, 3,052,544, 3,137,577, 3,220,839, 3,226,213, 3,236,652, 3,251,691, 3,252,799, 3,287,135, 3,326,681, 3,420,668 and 3,622,339, British Pat. Nos. 893,428, 403,789, 1,173,609 and 1,200,188, as well as in K. Mees, *The Theory of the Photographic Process,* 3rd Ed. (1966) and the literature reference cited therein.

The photographic emulsion used in the present invention can also contain a surface active agent individually or as a mixture thereof. These surface active agents are commonly used as a coating aid. However, in some cases they are used for the purposes of emulsion dispersion, sensitization, static prevention, adhesion prevention, etc.

The surface active agents can be classified into various groups, as follows: a natural surface active agent such as saponin, etc.; a nonionic surface active agent such as an alkylene oxide, a glycerol and a glycidol, etc.; a cationic surface active agent such as a higher alkylamine, a quaternary ammonium salt, a heterocyclic compound such as pyridine and the like, a phosphonium, a sulfonium, etc.; an anionic surface active agent containing an acid group such as a carboxylic acid group, a sulfonic acid group, a phosphoric acid group, a sulfuric acid ester group, a phosphoric acid ester group, etc.; an amphoteric surface active agent such as an amino acid, an aminosulfonic acid, an amino alcohol sulfuric acid ester, an amino alcohol phosphoric acid ester, etc. Some examples of those surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, West German Patent Application (OLS) No. 1,942,665, British Pat. Nos. 1,077,317 and 1,198,450, as well as Ryohei Oda, et al., *Kaimenkasseizai no Gosei to Sono Oyo (Synthesis and Application of Surface Active Agents)*, Maki Shoten (1964), A. W. Perry, *Surface Active Agents*, Interscience Publications, Inc. (1958) and J. P. Sisley, *Encyclopedia of Surface Active Agents, Vol. II, Chemical Publishing Co.* (1964), etc.

The photographic emulsion can be spectrally sensitized, or supersensitized, using a cyanine-type dye, such as cyanine, merocyanine, carbocyanine, etc., individually, in combination or in combination with a styryl dye.

These spectral sensitization techniques are well known, and are described, for example, in U.S. Pat. Nos. 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68 and 14030/69, etc. The sensitizers can be selected as desired depending on the wavelength range, sensitivity etc., due to the purpose and use of the photographic light-sensitive material to be sensitized.

The hydrophilic colloid layer, and in particular, a gelatin layer in the photographic light-sensitive material used in the present invention can be hardened using various kinds of cross-linking agents. For instance, an inorganic compound such as a chromium salt, a zirconium salt, etc., or an aldehyde type cross-linking agent such as mucochloric acid, or 2-phenoxy-3-chloromalealdehydic acid as described in Japanese Patent Publication No. 1872/71 can be effectively used in the present invention. However, a non-aldehyde type cross-linking agent such as a compound having plural epoxy rings as described in Japanese Patent Publication No. 7133/59, a poly(1-aziridinyl) compound as described in Japanese Patent Publication No. 8790/62, an active halogen compound as described in U.S. Pat. Nos. 3,362,827 and 3,325,287, a vinyl sulfone compound as described in U.S. Pat. Nos. 2,994,611 and 3,582,322, Belgian Pat. No. 686,440, etc., are particularly suitable for use in the photographic light-sensitive material of the present invention.

The silver halide photographic emulsion according to the present invention is suitably applied to a support. Illustrative supports include a rigid material such as glass, a metal and a ceramic, and a flexible material and the type of support chosen depends on the end-use objects. Typical examples of flexible supports include a cellulose nitrate film, a cellulose acetate film, a polyvinyl acetal film, a polystyrene film, a polyethylene terephthalate film, a polycarbonate film and a laminate thereof, a baryta coated paper, a paper coated with an α-olefin polymer, such as polyethylene, polypropylene and an ethylene-butene copolymer, a plastic film having a roughened surface as described in Japanese Patent Publication No. 19068/72, and the like. Depending upon the end-use objects of the photographic light-sensitive material, the support can be transparent, colored by adding a dye or pigment, opaque by adding, for example, titanium white, or light-shielding by adding, for example, carbon black.

The layer of the photographic light-sensitive material can be coated on a support using various coating methods, including a dip coating method, an air-knife coating method, a curtain coating method, an extrusion coating method using a hopper as described in U.S. Pat. No. 2,681,294. Also, two or more layers can be coated simultaneously, using methods as described in U.S. Pat. Nos. 2,761,791, 3,508,947, 2,941,898, 3,526,528, etc.

In order to incorporate a coupler into a silver halide emulsion layer, a known method, for example, the method as described in U.S. Pat. No. 2,322,027 can be employed. For example, the coupler may be dissolved in an organic solvent having a high boiling point, for example, a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a critic acid ester (e.g., tributyl acetylcitrate, etc.), a benzoic acid ester (e.g., octyl benzoate, etc.), an alkylamide (e.g., diethyl laurylamide, etc.), a fatty acid ester (e.g., dibutoxyethyl succinate, dioctyl azelate, etc.), a trimesic acid ester (e.g., tributyl trimesate, etc.), etc., or in an organic solvent having a low boiling point of from about 30° to about 150° C. for example, a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, etc., and then the solution is dispersed in a hydrophilic colloid. The above-described organic solvent having a high boiling point and the above-described organic solvent having a low boiling point may be used as a mixture, if desired.

Furthermore, the dispersing method using a polymeric material as described in Japanese Patent Publication No. 39853/76 and Japanese Patent Application (OPI) No. 59943/76 can also be used.

When a coupling having an acid group, such as a carboxylic acid group, a sulfonic acid group, etc., is used, it can be incorporated in a hydrophilic colloid as an alkaline aqueous solution thereof.

In practice of the present invention, a known fade-preventing agent can be used. A color image stablizing agent can be used individually or in a combination two or more thereof. Examples of known fade-preventing agents include a hydroquinone derivative, a gallic acid derivative, a p-alkoxyphenol, a p-oxyphenol derivative or a bisphenol, etc.

Specific examples of hhydroquinone derivatives are described in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc. Specific examples of gallic acid derivatives are described in U.S. Pat. Nos. 3,457,079 and 3,069,262, etc. Specific examples of p-alkoxyphenols are described in U.S. Pat. Nos. 2,735,765 and 3,698,909, Japanese Patent Publication Nos. 20977/74 and 6623/77, etc. Specific examples of p-oxyphenol derivatives are described in U.S. Pat. Nos. 3,432,300, 3,573,050 3,574,627 and 3,764,337, Japanese Patent Application (OPI) Nos. 35633/77, 147434/77 and 152225/77, etc. Specific examples of bisphenols are described in U.S. Pat. No. 3,700,455.

The photographic light-sensitive material of the present invention may contain an ultraviolet light absorbing agent in a hydrophilic colloid layer. For example, a benzotriazole compound substituted with an aryl group (for example, those described in U.S. Pat. No. 3,533,794, etc.), a 4-thiazolidone compound (for example, those described in U.S. Pat. Nos. 3,314,794 and 3,352,681, etc.), a benzophenone compound (for example, those described in Japanese Patent Application (OPI) No. 2784/71, etc.), a cinnamic acid ester compound (for example, those described in U.S. Pat. Nos. 3,705,805 and 3,707,375, etc.), or a benzoxazole compound (for example, those described in U.S. Pat. No. 3,499,762, etc.) can be employed. Further, an ultraviolet light absorbing coupler (for example, an α-naphthol type cyan dye forming coupler, etc.) or an ultraviolet light absorbing polymer can also be employed. These ultraviolet light absorbing agents may be mordanted in the specific layer. Moreover, these ultraviolet light absorbing agents may be incorporated into the layer containing the cyan polymer coupler according to the present invention.

The present invention is applicable to not only the so-called multilayer type photographic light-sensitive material comprising a support having super-imposed thereon emulsion layers, each of which is sensitive to radiation of a substantially different wavelength region and forms color images of a substantially different hue, but also the so-called mixed packet type photographic light-sensitive material comprising a support having coated thereon a layer containing packets which are sensitive to radiation of substantially different wavelength regions and form color images of a substantially different hue. The present invention can be applied to various types of photographic materials, for example, a color negative film, a color positive film, a color reversal film, a color printing paper, a color reversal printing paper, and the like.

The color photographic light-sensitive material of the present invention is, after exposure, subjected to a development processing to form dye images. Development processing includes basically a color development step, a bleaching step and a fixing step. Each step can be carried out individually or two or more steps can be combined as one step where a processing solution having two or more functions is used. Also, each step can be separated into two or more steps. The development processing can further include a pre-hardening step, a neutralization step, a first development (black-and-white development) step, a stabilizing step, a water washing step, and the like, if desired. The temperature of processing can be varied depending on the photographic light-sensitive material, the processing method, and the like. In general, the processing steps are carried out at a temperature from 18° C. to 60° C. These steps need not necessarily be conducted at the same temperature.

A color developing solution is an alkaline solution having a pH of more than 8, preferably from 9 to 12, and containing, as a developing agent, a compound whose oxidation product is capable of forming a colored compound when reacted with a color forming agent, i.e., a color coupler. The developing agent described above include a compound capable of developing an exposed silver halide and having a primary amino group on an aromatic ring, and a precursor which forms such compound. Typical examples of preferred developing agents are, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-ethoxyethylaniline, 4-amino-3-methoxy-N-ethyl-N-β-methoxyethylaniline, 4-amino-3-β-methanesulfonamidoethyl-N,N-diiethylaniline, and a salt thereof (for example, a sulfate, a hydrochloride, a sulfite, a p-toluene sulfonate, and the like). Other developing agents such as those described in U.S. Pat. Nos. 2,193,015, and 2,592,364, Japanese Patent Application (OPI) No. 64933/73, L. F. A. Mason, *Photographic Processing Chemistry,* pages 226 to 229, Focal Press, London (1966), T. H. James, *The Theory of the Photographic Process,* 4th Edition, pages 315 to 320, Macmillan, New York (1977), etc., can be used. Further, an aminophenol as described in T. H. James, *The Theory of the Photographic Process,* 4th Edition, pages 311 to 315, etc., can be used. Also, a 3-pyrazolidone developing agent can be used together with these developing agents.

The color developing solution can optionally contain various additives. Typical examples of such additives include an alkaline agent (for example, an alkali metal or ammonium hydroxide, carbonate or phosphate, etc.); a pH-adjusting agent or buffer (for example, a weak acid such as acetic acid, boric acid, etc., a weak base, or salt thereof, etc.); a developing accelerator (for example, various pyridinium compounds or cationic compounds such as those described in U.S. Pat. Nos. 2,648,604 and 3,671,247; potassium nitrate; sodium nitrate; a condensation product of polyethyleneglycol, and a derivative thereof such as those described in U.S. Pat. Nos. 2,533,990, 2,577,127 and 2,950,970; a nonionic compound such as a polythioether represented by those described in British Pat. Nos. 1,020,033 and 1,020,032; a polymeric compound having a sulfite ester such as those described in U.S. Pat. No. 3,068,097; an organic amine such as pyridine and ethanolamine; benzyl alcohol; a hydrazine and the like); an anti-fogging agent (for example, an alkali metal bromide; an alkali metal iodide; a nitrobenzimidazole such as those described in U.S. Pat. Nos. 2,496,940 and 2,656,271; mercaptobenzimidazole; 5-methylbenzotriazole; 1-phenyl-5-mercaptotetrazole; a compound for use in rapid processing such as those described in U.S. Pat. Nos. 3,113,864, 3,342,596, 3,295,976, 3,615,522 and 3,597,199; a thiosulfonyl compound such as those described in British Pat. No. 972,211; a phenazine-N-oxide such as those described in Japanese Patent Publication No. 41675/71; those described in *Kagaku Shashin Binran* (*Manual of Scientific Photography*), Vol. II, pages 29 to 47, and the like); a stain or sludge preventing agent such as those described in U.S. Pat. Nos. 3,161,513 and 3,161,514, and British Pat. Nos. 1,030,442, 1,144,481 and 1,251,558; an interlayer-effect accelerator as disclosed in U.S. Pat. No. 3,536,487; a preservative (for example, a sulfite, a bisulfite, hydroxylamine hydrochloride, formsulfite, an alkanolaminesulfite adduct, etc.) and the like.

The color photographic light-sensitive material of the present invention can be treated with various solutions prior to color development.

In the case of color reversal films, treatment with a first development solution is also carried out prior to the color development. As the first development solution, an alkaline aqueous solution containing at least one developing agent, such as hydroquinone, 1-phenyl-3-pyrazolidone, N-methyl-p-aminophenol and the like can be employed. The solution can also contain an inorganic salt such as sodium sulfate, etc.; a pH-adjusting agent or buffer such as borax, boric acid, sodium hydroxide and sodium carbonate, etc.; a development fog preventing agent such as an alkali metal halide (such as potassium bromide, etc.), and the like.

The additives illustrated above and the amounts thereof employed are well known in the color processing field.

After color development, the color photographic materials are usually bleached and fixed. The process can be effected in a blix bath which combines the bleaching and fixing steps. Various known compounds can be used as a bleaching agent, for example, a ferricyanide, a dichromate; a water-soluble iron (III) salt, a water-soluble cobalt (III) salt; a water-soluble copper (II) salt; a water-soluble quinone; a nitrosophenol, a complex salt of a polyvalent cation such as iron (III), cobalt (III), copper (II), etc., and an organic acid, for example, a metal complex of an aminopolycarboxylic acid such as ethylenediaminetetraacetic acid, nitrilotriacetic acid, iminodiacetic acid, N-hydroxyethylethylenediaminetriacetic acid, etc., malonic aciid, tartaric acid, malic acid, diglycolic acid and dithioglycolic acid, and a copper complex salt of 2,6-dipicolinic acid; a peracid such as an alkylperacid, a persulfate, a permanganate and hydrogen peroxide; hypochlorite; chlorine; bromine; bleaching powder; and the like. These can be suitably used, individually or in combination. To the bleaching solution, a bleaching accelerator such as those described in U.S. Pat. Nos. 3,042,520 and 3,241,966, Japanese Patent Publication Nos. 8506/70 and 8836/70 and various other additives can be added.

Any known fixing solution can be used for fixing the photographic material of the present invention. That is, ammonium, sodium, or potassium thiosulfate can be used as a fixing agent at a concentration of about 50 to about 200 g/liter. The fixing solution can further contain a stabilizer such as a sulfite and a metabisulfite; a hardener such as potassium alum; a pH buffer such as an acetate and a borate, and the like.

Bleaching bath, fixing bath and blixing bath as described, for example, in U.S. Pat. Nos. 3,582,322, Japanese Patent Application (OPI) No. 101934/73, West German Pat. No. 1,051,117, etc., can also be employed.

The present invention will be explained in greater detail with reference to the following examples, but the present invention should not be construed as being limited thereto.

EXAMPLE 1

On a paper support both surfaces of which were laminated with polyethylene were coated a first layer (undermost layer) to a sixth layer (uppermost layer) as shown in Table 1 below in order to prepare a color photographic light-sensitive material which is designated Sample 1. In Table 1 below, a coating amount is set forth in mg/m$^2$.

TABLE 1

| | | |
|---|---|---|
| Sixth Layer: (protective layer) | Gelatin | (1,600 mg/m$^2$) |
| Fifth Layer: | Silver chlorobromide emulsion | |
| | (silver bromide: | 50 mol % |
| | silver: | 300 mg/m$^2$) |
| | Cyan coupler*1 | (400 mg/m$^2$) |
| | Coupler solvent*2 | (300 mg/m$^2$) |
| | Gelatin | (500 mg/m$^2$) |
| Fourth Layer: (ultraviolet light absorbing layer) | Ultraviolet light absorbing agent*3 | (600 mg/m$^2$) |
| | Ultraviolet light absorbing agent solvent*2 | (300 mg/m$^2$) |
| | Gelatin | (800 mg/m$^2$) |
| Third Layer (green-sensitive layer) | Silver chlorobromide emulsion | |
| | (silver bromide: | 70 mol % |
| | silver: | 500 mg/m$^2$) |
| | Magenta coupler*4 | (400 mg/m$^2$) |
| | Fade-preventing agent*5 | (200 mg/m$^2$) |
| | Coupler solvent*6 | (400 mg/m$^2$) |
| | Gelatin | (700 mg/m$^2$) |
| Second Layer: (intermediate layer) | Gelatin | (1,000 mg/m$^2$) |
| First Layer: (blue-sensitive layer) | Silver chlorobromide emulsion | |
| | (silver bromide: | 80 mol % |
| | silver: | 400 mg/m$^2$) |
| | Yellow coupler*7 | (500 mg/m$^2$) |
| | Coupler solvent*2 | (400 mg/m$^2$) |
| | Gelatin | (700 mg/m$^2$) |
| Support: | Paper support both surfaces of which were laminated with polyethylene | |

*1Cyan coupler: 2-[α-(2,4-Di-tert-pentylphenoxy)-butanamido]-4,6-dichloro-5-methylphenol
*2Solvent: Trinonyl phosphate
*3Ultraviolet light absorbing agent: 2-(2-Hydroxy-3-sec-butyl-5-tert-butylphenyl)benzotriazole
*4Magenta coupler: 1-(2,4,6-Trichlorophenyl)-3-(2- chloro-5-tetradecanamido)-anilino-2-pyrazolin-5-one
*5Fade-preventing agent: 2,5-Di-tert-hexylhydroquinone
*6Coupler solvent: Tricresyl phosphate
*7Yellow coupler: α-pivaloyl-α-(2,4-dioxo-5,5'-dimethyloxazolidin-3-yl)-2-chloro-5-[α-(2,4-di-tert-pentylphenoxy)-butanamido]acetanilide Sample 2 was prepared in the same manner as described in Sample 1 except that the cyan coupler solvent in Sample 1 was eliminated. Also, Samples 3, 4 and 5 were prepared in the same manner as described in Sample 2 except that 400 mg/m$^2$ of the oleophilic cyan polymer coupler latexes having the structure represented by the formulae (1), (2) and (3) shown below were used respectively in place of the cyan coupler in Sample 2.

Formula (1)

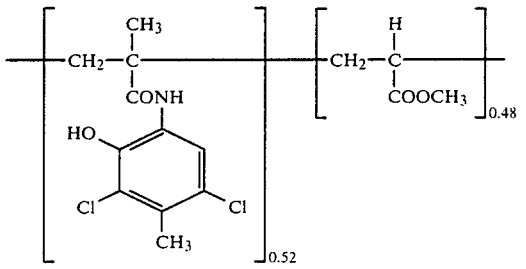

Formula (2)

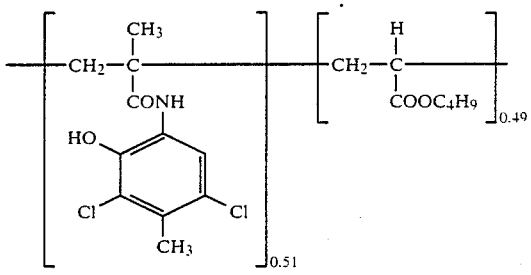

-continued

Formula (3)

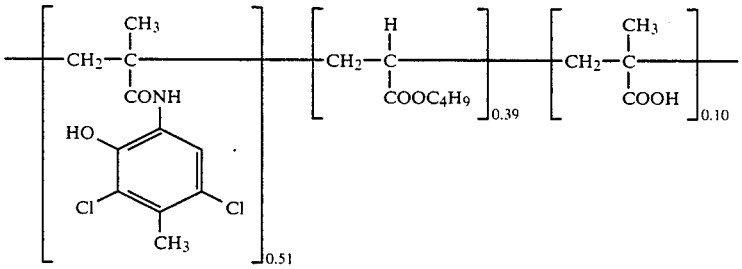

Further, Samples 6 and 7 were prepared in the same manner as described in Sample 2 except that 400 mg/m$^2$ of Oleophilic Cyan Polymer Coupler (A) in the form of a latex and 400 mg/m$^2$ (in an amount of the polymer coupler) of Polymer Coupler Latex (I) according to the present invention were used respectively in place of the cyan coupler in Sample 2.

Each sample was exposed to red light through a continuous wedge and subjected to color development processing in the following manner.

| Processing Step | Temperature | Time |
|---|---|---|
| Color Development | 33° C. | 3 min 30 sec |
| Bleach-Fixing | 33° C. | 1 min 30 sec |
| Washing with Water | 30° C. | 3 min |
| Drying | | |

The processing solutions used in the color development processing had the following compositions:

| | |
|---|---|
| Color Development Solution | |
| Benzyl Alcohol | 15 ml |
| Sodium Sulfite | 5 g |
| Potassium Bromide | 0.4 g |
| Hydroxylamine Sulfate | 2 g |
| 4-(N—Ethyl-N—β-methanesulfonamido)-2-methylaniline.Sesquisulfate | 2 g |
| Sodium Carbonate (monohydrate) | 30 g |
| Water to make | 1,000 ml (pH 10.1) |
| Bleach-Fixing Solution | |
| Ferric Ethylenediaminetetraacetate | 45 g |
| Sodium Sulfite | 10 g |
| Ammonium Thiosulfate (70% aq. soln.) | 160 ml |
| Tetrasodium Ethylenediaminetetraacetate | 5 g |
| Water to make | 1,000 ml (pH 6.8) |

The color density exposed to red light in each sample after development processing was measured. The fog, gamma and maximum density in each sample are shown in Table 2 below.

TABLE 2

| Sample | Fog | Gamma | Maximum Density | Remarks |
|---|---|---|---|---|
| 6 | 0.11 | 3.04 | 3.09 | Present Invention |
| 7 | 0.12 | 3.01 | 3.00 | Present Invention |
| 1 | 0.12 | 3.03 | 3.01 | Comparison |
| 2 | 0.11 | 2.99 | 3.13 | Comparison |
| 3 | 0.12 | 2.55 | 2.47 | Comparison |
| 4 | 0.12 | 2.80 | 2.87 | Comparison |
| 5 | 0.12 | 2.83 | 2.95 | Comparison |

As is apparent from the results shown in Table 2 above, in Sample 3 containing the latex of the oleophilic cyan polymer coupler for comparison the color formation is inferior. On the contrary, Samples 6 and 7 containing the oleophilic cyan polymer coupler latexes according to the present invention have excellent color forming properties.

Further, Samples 1 to 7 after development processing were maintained in an almost dry atmosphere at 80° C. for 3 weeks and then the density reduction rates of the cyan color image in the areas where the initial densities were 1.0 (D 1.0) and 2.0 (D 2.0) were measured. The results thus obtained are shown in Table 3 below.

TABLE 3

| | 80° C., 3 Weeks | | |
|---|---|---|---|
| Sample | D 1.0 (%) | D 2.0 (%) | Remarks |
| 6 | 7 | 5 | Present Invention |
| 7 | 12 | 10 | Present Invention |
| 1 | 46 | 50 | Comparison |
| 2 | 51 | 48 | Comparison |
| 3 | 28 | 27 | Comparison |
| 4 | 40 | 37 | Comparison |
| 5 | 22 | 21 | Comparison |

In Table 3 above, the heat fastness is more excellent as the density reduction rate (%) is small. It is apparent from the results shown in Table 3 above that the cyan couplers (Samples 6 and 7) according to the present invention have extremely good heat fastness in comparison with the comparison couplers (Samples 1 to 5).

EXAMPLE 2

On a cellulose triacetate support were coated a first layer (undermost layer) to a sixth layer (uppermost layer) as shown in Table 4 below in order to prepare a multilayer color photographic light-sensitive material which is designated Sample 8. In Table 4 below, a coating amount is set forth in mg/m$^2$.

TABLE 4

| | | |
|---|---|---|
| Sixth Layer: (protective layer) | Gelatin | (750 mg/m$^2$) |
| Fifth Layer: (green-sensitive layer) | Silver chlorobromide emulsion | |
| | (silver bromide: | 30 mol % |
| | silver: | 500 mg/m$^2$) |
| | Magenta coupler*1 | (600 mg/m$^2$) |
| | Coupler solvent*2 | (110 mg/m$^2$) |
| | Gelatin | (1,300 mg/m$^2$) |
| Fourth Layer: (intermediate layer) | Gelatin | (500 mg/m$^2$) |
| Third Layer: (red-sensitive layer) | Silver chlorobromide emulsion | |
| | (silver bromide: | 30 mol % |
| | silver: | 500 mg/m$^2$) |
| | Cyan coupler*3 | (1,500 mg/m$^2$) |
| | Coupler solvent*4 | (700 mg/m$^2$) |
| | Gelatin | (2,900 mg/m$^2$) |
| Second Layer: (intermediate layer) | Gelatin | (500 mg/m$^2$) |
| First Layer: | Silver iodobromide emulsion | |

TABLE 4-continued

| | | |
|---|---|---|
| (blue-sensitive layer) | (silver iodide: | 0.2 mol % |
| | silver: | 1,000 mg/m$^2$) |
| | Yellow coupler*5 | (1,200 mg/m$^2$) |
| | Coupler solvent*2 | (600 mg/m$^2$) |
| | Gelatin | (2,200 mg/m$^2$) |
| Support | Cellulose triacetate | |

*1Magenta coupler: 3-{3-[2-(2,4-Di-tert-pentylphenoxy)-acetamido]benzamido}-1-(2,4,6-trichlorophenyl)-2-pyrazolin-5-one
*2Coupler solvent: Tricresyl phosphate
*3Cyan coupler: 2-[α-(2,4-Di-tert-pentylphenoxy)-butanamido]-4,6-dichloro-5-methylphenol
*4Coupler solvent: Dibutyl phthalate
*5Yellow coupler: α-Pivaloyl-α-(2,4-dioxo-5,5-dimethyloxazolidin-3-yl)-2-chloro-5-[α-(2,4-di-tert-pentylphenoxy)-butanamido]acetanilide Sample 9 was prepared in the same manner as described in Sample 8 except that the cyan coupler solvent in Sample 8 was eliminated. Also, Samples 10 was prepared in the same manner as described in Sample 9 except that 1,500 mg/m$^2$ of the oleophilic cyan polymer coupler having the structure shown below was used in place of the cyan coupler in Sample 9.

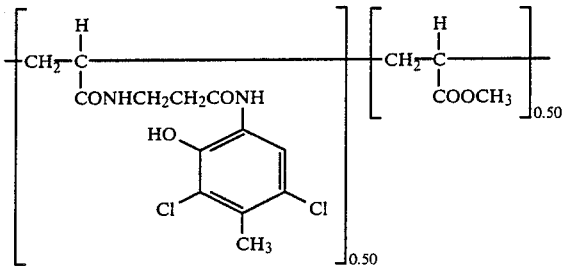

Further, Samples 11, 12, 13 and 14 were prepared in the same manner as described in Sample 10 except that 1,500 mg/m$^2$ of Oleophilic Cyan Polymer Coupler (N), 1,500 mg/m$^2$ of Oleophilic Cyan Polymer Coupler (C) and 1,500 mg/m$^2$ of Oleophilic Cyan Polymer Coupler (O) in the form of a latex and 1,500 mg/m$^2$ (in an amount of the polymer coupler) of Polymer Coupler Latex (II) according to the present invention were used respectively in place of the oleophilic cyan polymer coupler in Sample 10.

Each sample was exposed to blue light, green light and red light through a continuous wedge and subjected to the following color development processing.

| Processing Step | Temperature | Time |
|---|---|---|
| Color Development | 36° C. | 3 min |
| Stopping | 36° C. | 40 sec |
| First Fixing | 36° C. | 40 sec |
| Bleaching | 36° C. | 1 min |
| Second Fixing | 36° C. | 40 sec |
| Washing with Water | 30° C. | 30 sec |

The processing solutions used in the color development processing had the following compositions:

| | |
|---|---|
| Color Development Solution | |
| Sodium Sulfite | 5 g |
| 4-Amino-3-methyl-N,N—diethylaniline | 3 g |
| Sodium Carbonate | 20 g |
| Potassium Bromide | 2 g |
| Water to make | 1 liter (pH: 10.5) |
| Stopping Solution | |
| 6 N Sulfuric Acid | 50 ml |

-continued

| | |
|---|---|
| Water to make | 1 liter (pH: 1.0) |
| Fixing Solution | |
| Ammonium Thiosulfate | 60 g |
| Sodium Sulfite | 2 g |
| Sodium Hydrogensulfite | 10 g |
| Water to make | 1 liter (pH: 5.8) |
| Bleaching Solution | |
| Potassium Ferricyanide | 30 g |
| Potassium Bromide | 15 g |
| Water to make | 1 liter (pH: 6.5) |

The color density at the portion exposed to red light in each sample after development processing was measured. The fog, gamma and maximum density in each sample are shown in Table 5 below.

TABLE 5

| Sample | Fog | Gamma | Maximum Density | Remarks |
|---|---|---|---|---|
| 11 | 0.06 | 3.12 | 3.35 | Present Invention |
| 12 | 0.06 | 3.09 | 3.27 | Present Invention |
| 13 | 0.07 | 3.04 | 3.22 | Present Invention |
| 14 | 0.06 | 3.11 | 3.28 | Present Invention |
| 8 | 0.06 | 3.13 | 3.45 | Comparison |
| 9 | 0.07 | 2.97 | 2.99 | Comparison |
| 10 | 0.06 | 3.10 | 3.27 | Comparison |

Further, Samples 8 to 14 after development processing were maintained in an almost dry atmosphere at 80° C. for 2 weeks and then the density reduction rates of the cyan color images in the areas where the initial densities were 1.0 (D 1.0) and 2.0 (D 2.0) were measured. The results thus obtained are shown in Table 6 below.

TABLE 6

| | 80° C., 2 Weeks | | |
|---|---|---|---|
| Sample | D 1.0 (%) | D 2.0 (%) | Remarks |
| 11 | 17 | 15 | Present Invention |
| 12 | 13 | 10 | Present Invention |
| 13 | 8 | 7 | Present Invention |
| 14 | 12 | 13 | Present Invention |
| 8 | 70 | 73 | Comparison |
| 9 | 65 | 65 | Comparison |
| 10 | 28 | 25 | Comparison |

It is apparent from the results shown in Tables 5 and 6 above that Samples 11 and 14 according to the present invention have excellent color forming properties and heat fastness in comparison with Samples 8 to 10 for comparison.

EXAMPLE 3

Samples 15 and 16 were prepared in the same manner as described in Samples 1 and 2 in Example 1. Also, Sample 17 was prepared in the same manner as described in Sample 16 except that a latex of the oleophilic cyan polymer coupler having the structure shown below was used in place of the cyan coupler in Sample 16.

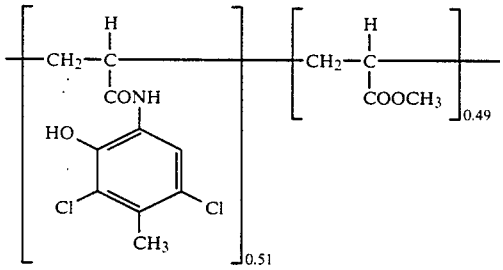

Further, Samples 18, 19 and 20 were prepared in the same manner as described in Sample 17 except that 400 mg of Oleophilic Cyan Polymer Coupler (H), 400 mg of Oleophilic Cyan Polymer Coupler (B) and 400 mg of Oleophilic Cyan Polymer Coupler (I) in the form of the latex according to the present invention were used respectively in place of the oleophilic cyan polymer coupler in Sample 17.

Each sample was exposed to red light through a continuous wedge and subjected to the development processing as described in Example 1. Samples 15 to 20 after development processing were maintained in an almost dry atmosphere at 80° C. for 3 weeks and then the density reduction rates of the cyan color images in the areas where the initial densities were 1.0 (D 1.0) and 2.0 (D 2.0) were measured. The results thus obtained are shown in Table 7 below.

TABLE 7

| | 80° C., 3 Weeks | | |
|---|---|---|---|
| Sample | D 1.0 (%) | D 2.0 (%) | Remarks |
| 18 | 10 | 8 | Present Invention |
| 19 | 12 | 11 | Present Invention |
| 20 | 7 | 6 | Present Invention |
| 15 | 48 | 52 | Comparison |
| 16 | 50 | 51 | Comparison |
| 17 | 25 | 27 | Comparison |

It is apparent from the results shown in Table 7 above that Samples 18 to 20 according to the present invention have excellent heat fastness in comparison with Samples 15 to 17 for comparison.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer containing a cyan color image forming polymer coupler latex which comprises at least one reducing unit of a cyan coupler monomer capable of forming a dye upon coupling with an oxidation product of an aromatic primary amine developing agent represented by the general formula (I) described below, at least one recurring unit of an ethylenically unsaturated monomer containing an acid component represented by the general formula (II) described below and at least one recurring unit of methyl acrylate

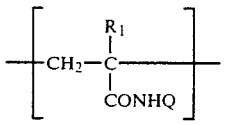

(I)

wherein $R_1$ represents a hydrogen atom, a lower alkyl group containing from 1 to 4 carbon atoms or a chlorine atom; and Q represents a cyan coupler residue capable of forming a cyan dye upon coupling with an oxidized aromatic primary amine developing agent,

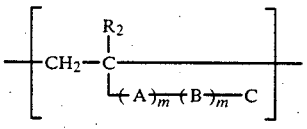

(II)

wherein $R_2$ represents a hydrogen atom, a lower alkyl group containing from 1 to 4 carbon atoms or a chlorine atom; A represents —COO— or —CONH—; B represents an alkylene group containing from 1 to 10 carbon atoms which may be a straight chain, a branched chain or a cyclic, an aralkylene group containing from 7 to 18 carbon atoms or a phenylene group containing from 6 to 10 carbon atoms (inclusive of carbon atoms of substituents for the phenylene group); C represents —COOM or —$SO_3M$; M represents a hydrogen atom ion, an alkali metal ion, an alkaline earth metal ion or an ammonium ion; and m represents 0 or 1.

2. A silver halide color photographic light-sensitive material as claimed in claim 1, wherein the cyan coupler residue represented by Q is a cyan color forming phenol type or naphthol type coupler residue.

3. A silver halide color photographic light-sensitive material as claimed in claim 1, wherein the cyan coupler residue represented by Q is a phenol type residue represented by the following general formula (III), a phenol type residue represented by the following general formula (IV) or a naphthol type residue represented by the following general formula (V):

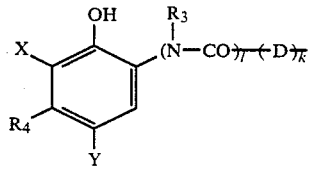

[III]

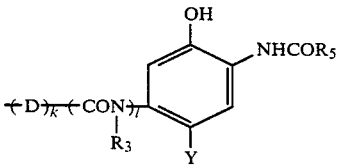

[IV]

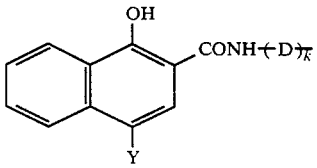

[V]

wherein $R_3$ represents a hydrogen atom or a lower alkyl group having from 1 to 4 carbon atoms; D bonds to the NH group in the general formula (I) and represents an unsubstituted or substituted alkylene group having from 1 to 10 carbon atoms which may be a straight chain or a branched chain, an unsubstituted or substituted aralkylene group having from 7 to 18 carbon atoms or an unsubstituted or substituted phenylene group having from 6 to 18 carbon atomes; $R_4$ represents a hydrogen atom or a lower alkyl group having from 1 to 5 carbon atoms; $R_5$ represents an unsubstituted or substituted alkyl group, an unsubstituted or substituted phenyl group or an unsubstituted or substituted phenylamino group; X represents a halogen atom; Y represents a hydrogen atom, a halogen atom or a substituted alkoxy group; k represents 0 or 1; and l represents 0 or 1.

4. A silver halide color photographic light-sensitive material as claimed in claim 3, wherein the substituent for the substituted alkylene group, the substituted aralkylene group or the substituted phenylene group represented by D is an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group or a sulfonyl group.

5. A silver halide color photographic light-sensitive material as claimed in claim 3, wherein the substituent for the substituted alkoxy group represented by Y is an aryl group, a nitro group, a hydroxy group, a cyano group, a sulfo group, an alkoxy group, an aryloxy group, an acyloxy group, an acylamino group, an alkylsulfonamido group, an alkylsulfamoyl group, a halogen atom, a carboxy group, an alkylcarbamoyl group, an alkoxycarbonyl group, an alkylsulfonyl group or an alkylthio group.

6. A silver halide color photographic light-sensitive material as claimed in claim 3, wherein the substituent for the substituted alkyl group or the substituted phenyl group represented by $R_5$ is a fluorine atom.

7. A silver halide color photographic light-sensitive material as claimed in claim 3, wherein the substituent for the substituted phenylamino group represented by $R_5$ is a nitro group, a cyano group, a sulfonamido group, a sulfamoyl group, a halogen atom, a carbamoyl group or a sulfonyl group.

8. A silver halide color photographic light-sensitive material as claimed in claim 1, wherein the recurring unit represented by the general formula (II) is derived from an ethylenically unsaturated monomer containing an acid component which does not have an ability of oxidative coupling with an aromatic primary amine developing agent.

9. A silver halide color photographic light-sensitive material as claimed in claim 8, wherein the ethylenically unsaturated monomer is acrylic acid, an α-chloroacrylic acid or an α-alkylacrylic acid.

10. A silver halide color photographic light-sensitive material as claimed in claim 8, wherein the ethylenically unsaturated monomer is an ester derived from acrylic acid, an α-chloroacrylic acid or an α-alkylacrylic acid which contains an acid component.

11. A silver halide color photographic light-sensitive material as claimed in claim 8, wherein the ethylenically unsaturated monomer is an amide derived from acrylic acid, an α-chloroacrylic acid or an α-alkylacrylic acid which contains an acid component.

12. A silver halide color photographic light-sensitive material as claimed in claim 1, wherein the cyan color image forming polymer coupler latex is a latex prepared by emulsion polymerization of monomers comprising a monomer corresponding to the recurring unit represented by the general formula (I), a monomer corresponding to the recurring unit represented by the general formula (II) and methyl acrylate.

13. A silver halide color photographic light-sensitive material as claimed in claim 1, wherein the cyan color image forming polymer coupler latex is a latex prepared by dissolving an oleophilic polymer coupler obtained by polymerization of monomers comprising a monomer corresponding to the recurring unit represented by the general formula (I), a monomer corresponding to the recurring unit represented by the general formula (II) and methyl acrylate in an organic solvent and then emulsion dispersing the solution in a latex form in an aqueous gelatin solution.

14. A silver halide color photographic light-sensitive material as claimed in claim 1, wherein the proportion of the color forming portion corresponding to the general formula (I) in the polymer coupler is from 5% to 80% by weight.

15. A silver halide color photographic light-sensitive material as claimed in claim 1, wherein the proportion of the color forming portion corresponding to the general formula (I) in the polymer coupler is from 20% to 70% by weight.

16. A silver halide color photographic light-sensitive material as claimed in claim 1, wherein the proportion of the non-color forming portion corresponding to the general formula (II) in the polymer coupler is from 1% to 30% by weight.

17. A silver halide color photographic light-sensitive material as claimed in claim 1, wherein the proportion of the non-color forming portion corresponding to the general formula (II) in the polymer coupler is from 5% to 20% by weight.

18. A silver halide color photographic light-sensitive material as claimed in claim 1, wherein the proportion of methyl acrylate in the polymer coupler is from 20% to 95% by weight.

19. A silver halide color photographic light-sensitive material as claimed in claim 1, wherein the proportion of methyl acrylate in the polymer coupler is from 30% to 70% by weight.

20. A silver halide color photographic light-sensitive material as claimed in claim 1, wherein the gram number of the polymer coupler containing 1 mol of coupler monomer is from 250 to 4,000.

21. A silver halide color photographic light-sensitive material as claimed in claim 1, wherein the silver halide emulsion layer containing a cyan color image forming polymer coupler latex is a red-sensitive silver halide emulsion layer.

22. A silver halide color photographic light-sensitive material as claimed in claim 21, wherein the photographic light-sensitive material further comprises a blue-sensitive silver halide emulsion layer containing a yellow color image forming coupler and a green-sensitive silver halide emulsion layer containing a magenta color image forming coupler.

23. A silver halide color photographic light-sensitive material as claimed in claim 1, wherein the cyan color image forming polymer coupler latex is used in an amount such that the amount of the color forming portion corresponding to the general formula (I) is from $2\times10^{-3}$ to $5\times10^{-1}$ mol per mol of silver.

24. A silver halide color photographic light-sensitive material as claimed in claim 1, wherein the polymer coupler latex is present in an amount such that the amount of the portion corresponding to the coupler monomer is from $1\times10^{-2}$ to $5\times10^{-1}$ mol per mol of silver.

25. A silver halide color photographic light-sensitive material as claimed in claim 1, wherein the polymer coupler latex is comprised of a plurality of different monomers represented by the general formula (I).

26. A silver halide color photographic light-sensitive material as claimed in claim 1, wherein the polymer coupler latex is comprised of a plurality of different monomer of the general formula (II).

27. A method of forming a color image comprising imagewise exposing a silver halide color photographic light-sensitive material comprising a support having thereon a silver halide emulsion layer containing a cyan color image forming polymer coupler latex which comprises at least one recurring unit of a cyan coupler monomer capable of forming a dye upon coupling with an oxidation product of an aromatic primary amine developing agent represented by the general formula (I) described below, at least one recurring unit of an ethylenically unsaturated monomer containing an acid component represented by the general formula (II) described below and at least one recurring unit of methyl acrylate

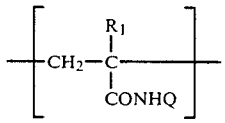

(I)

wherein $R_1$ represents a hydrogen atom, a lower alkyl group containing from 1 to 4 carbon atoms or a chlorine atom; and Q represents a cyan coupler residue capable of forming a cyan dye upon coupling with an oxidized aromatic primary amine developing agent

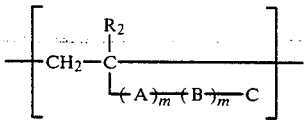

(II)

wherein $R_2$ represents a hydrogen atom, a lower alkyl group containing from 1 to 4 carbon atoms or a chlorine atom; A represents —COO— or —CONH—; B represents an alkylene group containing from 1 to 10 carbon atoms which may be a straight chain, a branched chain or a cyclic, an aralkylene group containing from 7 to 18 carbon atoms or a phenylene group containing from 6 to 10 carbon atoms (inclusive of carbon atoms of substituents for the phenylene group); C represents —COOM or —$SO_3M$: M represents a hydrogen atom ion, an alkali metal ion, an alkaline earth metal ion or an ammonium ion; and m represents 0 or 1 developing the exposed material using an alkaline aqueous solution containing an aromatic primary amine developing agent.

* * * * *